US008789491B2

(12) United States Patent
Nagahara et al.

(10) Patent No.: US 8,789,491 B2
(45) Date of Patent: Jul. 29, 2014

(54) INKJET PRINTING APPARATUS FOR APPLYING UNIFORM PRESSURE ON AN APPLYING ROLLER

(75) Inventors: Hideaki Nagahara, Yokohama (JP); Tetsuyo Ohashi, Yokohama (JP); Hiroshi Yoshino, Kawasaki (JP); Takeshi Sekino, Yokohama (JP); Keisei Hakamata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1265 days.

(21) Appl. No.: 12/355,410

(22) Filed: Jan. 16, 2009

(65) Prior Publication Data

US 2009/0183672 A1 Jul. 23, 2009

(30) Foreign Application Priority Data

Jan. 23, 2008 (JP) ..... 2008-013067

(51) Int. Cl.

| | |
|---|---|
| ***B05C 1/06*** | (2006.01) |
| ***B05C 1/00*** | (2006.01) |
| ***B41F 31/00*** | (2006.01) |
| ***B05C 1/08*** | (2006.01) |
| *B05D 1/28* | (2006.01) |
| *G03G 15/01* | (2006.01) |

(52) U.S. Cl.

CPC ..... *B05C 1/0869* (2013.01); *B05C 1/0834* (2013.01); *G03G 2215/2058* (2013.01)

USPC ..... 118/262; 118/222; 118/256; 118/261; 118/249; 427/428.21; 427/428.15; 427/428.1; 399/227; 101/349.1; 101/351.2; 101/351.3

(58) Field of Classification Search

CPC ..... B05C 1/0834; B05C 1/165; B05C 1/813; B05C 1/0869; B41F 16/00

USPC ..... 118/222, 256, 261, 262

See application file for complete search history.

(56) References Cited

U.S. PATENT DOCUMENTS 5,302,203 A * 4/1994 Zimmer ..... 118/117
6,331,002 B1 * 12/2001 Yoshino et al. ..... 271/117

(Continued)

FOREIGN PATENT DOCUMENTS

| | | |
|---|---|---|
| CN | 1660575 A | 8/2005 |
| JP | 3593795 | 9/2004 |
| JP | 2005-254229 | 9/2005 |

OTHER PUBLICATIONS

Office Action issued in Chinese Application No. 200910008421.8, dated Sep. 8, 2011.

*Primary Examiner* — Dah-Wei D Yuan
*Assistant Examiner* — Karl Kurple
(74) *Attorney, Agent, or Firm* — Fitzpatrick, Cella, Harper & Scinto

(57) ABSTRACT

A cap sheet metal (and pivot sheet metal) is configured to be able to move linearly with a cap arm (and an arm stay) via engagement between an engagement hole and a fitting shaft. Furthermore, the cap sheet metal (and the pivot sheet metal) can move pivotally with respect to the cap arm (and the arm stay) using the fitting shaft, which engages with the engagement hole, as a pivotal shaft. Thus, even if, for example, the direction of biasing toward the applying roller deviates or a positional relationship with the applying roller deviates slightly, the liquid holding member moves and pivots in the bias direction depending on the deviation. As a result, the contacting pressure of a contacting portion on the applying roller can be made uniform.

3 Claims, 11 Drawing Sheets

(56) References Cited

U.S. PATENT DOCUMENTS

| | | | | |
|---|---|---|---|---|
| 6,656,529 | B1 * | 12/2003 | Pankake | 427/356 |
| 7,391,988 | B2 * | 6/2008 | Igarashi et al. | 399/101 |
| 7,395,778 | B2 | 7/2008 | Iwasaki et al. | |
| 7,537,661 | B2 * | 5/2009 | Nakagawa et al. | 118/708 |
| 7,588,639 | B2 | 9/2009 | Iwasaki et al. | |
| 7,891,796 | B2 * | 2/2011 | Masuyama et al. | 347/93 |
| 8,014,712 | B2 * | 9/2011 | Lee et al. | 399/331 |
| 8,150,303 | B2 * | 4/2012 | Kim et al. | 399/328 |
| 2005/0034659 | A1 * | 2/2005 | Pankake | 118/413 |
| 2005/0178324 | A1 | 8/2005 | Iwasaki et al. | |
| 2007/0025783 | A1 * | 2/2007 | Jang et al. | 399/328 |
| 2007/0163492 | A1 * | 7/2007 | Michelbrink et al. | 118/249 |
| 2007/0217838 | A1 * | 9/2007 | Yamana et al. | 399/328 |
| 2008/0223290 | A1 | 9/2008 | Iwasaki et al. | |
| 2009/0183678 | A1 | 7/2009 | Yoshino et al. | 118/708 |
| 2009/0194019 | A1 | 8/2009 | Hakamata et al. | 118/244 |
| 2009/0232997 | A1 * | 9/2009 | Kusunoki | 427/428.01 |

* cited by examiner

INKJET PRINTING APPARATUS FOR APPLYING UNIFORM PRESSURE ON AN APPLYING ROLLER

BACKGROUND OF THE INVENTION

1. Field of the Invention

The present invention relates to a liquid applying apparatus and an ink jet printing apparatus, and specifically to a liquid applying apparatus that applies a liquid on a medium such as a print sheet for a predetermined purpose, for example, coagulation of an ink color material, and an ink jet printing apparatus including the liquid applying apparatus.

2. Description of the Related Art

Spin coaters, roll coaters, bar coaters, and die coaters are widely known as methods of applying a liquid or a liquid material on media. These applying methods are based on consecutive applying on relatively elongate applying media. Thus, for example, if applying media of a relatively small size are intermittently conveyed and then applied, applying beads may disadvantageously be displaced at an applying start or end position for each applying medium. Thus, for example, resulting coated films may be prevented from being uniform.

In the field of ink jet printing apparatuses, some known apparatuses use liquid applying mechanisms. For example, a liquid is applied on a print medium, which is then printed. Japanese Patent Laid-Open No. 2005-254229 proposes a liquid applying apparatus and an ink jet printing apparatus which reduce the adverse effect of an increase in the number of times an applying member such as an applying roller is used. The liquid applying mechanism includes a liquid holding member with a groove for liquid holding space in which an applying liquid is held, a liquid supply port through which the applying liquid is supplied to the groove, and a collection port through which the applying liquid is discharged from the liquid holding space. The liquid applying mechanism also includes a circulation system with a pump which supplies an applying liquid to the liquid holding space and which discharges the applying liquid from the liquid holding space. A contacting portion of the liquid holding member is biased by a bias force of a spring to contact with a peripheral surface of an applying roller so that the liquid holding member and the applying roller form the liquid holding space. The biasing prevents the applying liquid from leaking inadvertently from the liquid holding space while the applying roller is rotating or stopped. Rotation of the applying roller allows the applying liquid held in the liquid holding space to spread all over the peripheral surface of the roller. The applying liquid is thus transferred to and applied on the medium. Furthermore, the rotation of the applying roller allows the applying liquid remaining on the applying roller after the transfer to the medium to be collected in the liquid holding member.

For the above-described mechanism that applies the liquid using the liquid holding space formed by the liquid holding member and the applying roller, the contacting relationship between the liquid holding member, in which the applying liquid is contained, and the applying roller is relatively important matter. For example, the liquid holding member desirably abuts against the applying roller under a uniform pressure to appropriately keep the liquid holding space closed. On the other hand, during the applying of the liquid, an appropriate amount of applying liquid is desirably evenly applied on the medium by the rotating applying roller.

In the field of ink jet printing apparatuses, an apparatus described in Japanese Patent No. 3593795 is known as a technique that takes into account a contacting pressure of such a roller as described above. To maintain parallelism between a feeding roller and a pinch roller that presses the print medium against the feeding roller to exert a frictional conveying force, Japanese Patent No. 3593795 includes a mechanism that aligns rotating center shafts of the feeding roller and the pinch roller so as to place the rotating center shafts parallel to each other. Thus, the pressure under which the pinch roller abuts against the feeding roller can be made uniform.

However, in such a conventional liquid applying mechanism as described in Japanese Patent Laid-Open No. 2005-254229, the contacting relationship between the liquid holding member and the applying roller may be insufficient. More specifically, with the conventional configuration, which maintains the contacting relationship simply by the biasing with the spring, a uniform contacting pressure cannot be maintained unless a relatively accurate positional relationship is established between the liquid holding member and the applying roller. If the uniform contacting pressure fails to be maintained, the applying liquid may leak from the liquid holding member.

Furthermore, when the applying roller rotates to perform an applying operation, a liquid holding member desirably tightly contacts the applying roller on a side of the liquid holding member from which the applying liquid flows out, in order to evenly spread the applying liquid on the applying roller. On the other hand, during the applying operation, on a collection side of the liquid holding member, the applying liquid is desirably likely to flow into the liquid holding member. In contrast, such an applying mechanism as described in Japanese Patent Laid-Open No. 2005-254229 maintains the contacting relationship simply by the biasing with the spring. Thus, realizing the above-described behavior of the applying liquid by means of the applying mechanism is difficult.

On the other hand, the roller contacting mechanism described in Japanese Patent No. 3593795 includes the alignment mechanism aligning the rotating shafts of the two rollers, in addition to the biasing by the spring. Thus, applying of this contacting mechanism to the liquid applying mechanism described in Japanese Patent Laid-Open No. 2005-254229 allows the positional relationship between the centers of the liquid holding member and the applying roller to be accurately maintained. However, even a slight deviation in the bias direction of the spring hinders prevention of the contacting portion of the liquid holding member from contacting unevenly against the applying roller, as shown by a dashed line in FIG. 11. As a result, the closing force of the liquid holding member may become nonuniform.

Furthermore, if the mechanism in Japanese Patent No. 3593795 is used, the alignment mechanism needs to have loose fitting so as to enable automatic alignment. Thus, when the applying roller rotates forward or backward, the liquid holding member moves in conjunction with the rotating applying roller. In this case, when the liquid holding member moving in conjunction with the applying roller is stopped, the applying liquid may leak from the liquid holding space.

SUMMARY OF THE INVENTION

An object of the present invention is to provide a liquid applying apparatus and an ink jet printing apparatus which enable a liquid holding member to contact with an applying roller under a uniform pressure. Another object of the present invention is to provide an applying mechanism which, while the applying roller rotates to perform an applying operation, allows a liquid to spread evenly on the applying roller and also allows the liquid on the applying roller to be appropriately collected in the liquid holding member.

In a first aspect of the present invention, there is provided a liquid applying apparatus provided with an applying roller capable of rotating for applying a liquid on a medium while rotating the applying roller, said apparatus comprising: a liquid holding member that contacts with the applying roller to form a liquid holding space between said liquid holding member and a peripheral surface of the applying roller; a bias unit for biasing said liquid holding member toward the applying roller to cause said liquid holding member to contact with the applying roller; and a support unit for supporting said liquid holding member biased by said bias unit so that said liquid holding member is pivotally movable by means of a pivotal shaft.

Preferably, an axis of the pivotal shaft of said support unit is positioned inside a quadrangle formed by connecting a rotating center (P1) of the applying roller, a tangent point (P2) between the applying roller and an upstream side of said liquid holding member in rotation of the applying roller, a tangent point (P3) between the applying roller and a downstream side of said liquid holding member in the rotation of the applying roller, and an intersecting point (P4) between a tangent line of the applying roller passing through the upstream tangent point (P2) and a tangent line of the applying roller passing through the downstream tangent point (P3).

In a second aspect of the present invention, there is provided an ink jet printing apparatus that is provided with an applying roller capable of rotating for applying a liquid on a medium while rotating the applying roller, and ejects ink to the medium after the liquid is applied to the medium or before the liquid is applied to the medium to perform printing, said apparatus comprising: a liquid holding member that contacts with the applying roller to form a liquid holding space between said liquid holding member and a peripheral surface of the applying roller; a bias unit for biasing said liquid holding member toward the applying roller to cause said liquid holding member to contact with the applying roller; and a support unit for supporting said liquid holding member biased by said bias unit so that said liquid holding member is pivotally movable by means of a pivotal shaft.

Preferably, an axis of the pivotal shaft of said support unit is positioned inside a quadrangle formed by connecting a rotating center (P1) of the applying roller, a tangent point (P2) between the applying roller and an upstream side of said liquid holding member in rotation of the applying roller, a tangent point (P3) between the applying roller and a downstream side of said liquid holding member in the rotation of the applying roller, and an intersecting point (P4) between a tangent line of the applying roller passing through the upstream tangent point (P2) and a tangent line of the applying roller passing through the downstream tangent point (P3).

In particular, the above-described construction includes the support means for holding the liquid holding member biased by the bias means so that the liquid holding member is pivotally movable by means of the pivotal axis. Thus, even if, for example, the direction of biasing to the applying roller deviates or the positional relationship between the liquid holding member and the applying roller deviates slightly, the liquid holding member can move depending on the deviation. More specifically, even if such a deviation as described occurs, the liquid holding member moves in the bias direction and pivots depending on the deviation. Thus, the contacting pressure of a contacting portion of the liquid holding member on the applying roller can be made uniform. As a result, the liquid can be stably and evenly applied.

Furthermore, according to the preferred aspect of the invention, the axis of the pivotal shaft of the support means is positioned inside the quadrangle formed by connecting the rotating center (P1) of the applying roller, the tangent point (P2) between the applying roller and the upstream side of the liquid holding member in the rotation of the applying roller, the tangent point (P3) between the applying roller and the downstream side of the liquid holding member in the rotation of the applying roller, and the intersecting point (P4) between the tangent line of the applying roller passing through the upstream tangent point (P2) and the tangent line of the applying roller passing through the downstream tangent point (P3). Thus, when the roller rotates, at the downstream tangent point (P3), where the applying roller contacts the contacting member of the liquid holding member, a frictional force (Ff3) is exerted in a tangential direction of the applying roller and acts on the liquid holding member. This frictional force can be decomposed into a component force (Fn3) acting in the direction of a line connecting a pivotal shaft axis (2013C) and the tangent point (P3) and a component force (Ft3) acting in a direction perpendicular to the component force (Fn3). In this case, the component force (Fn3) passing through the fitting shaft axis (2013C) is canceled out by a reaction force provided by the pivotal shaft (2013) of the support member. Consequently, behavior of the liquid holding member depends on another component force (Ft3). Here, if the axis (2013C) of the pivotal shaft is in the above-described positional relationship, the component force (Ft3) acts in a direction in which the liquid holding member is tightly contacted with the applying roller. As a result, at the downstream contact point of the contacting member, the pressure contact force between the applying roller and the contacting member is stably increased to allow the liquid to be adhered in an even and thin film form. On the other hand, on the upstream side, based on the same principle and in contrast, the pressure contact force between the liquid holding member and the applying roller is reduced to allow the liquid to be more easily collected. As a result, when the applying roller rotates to perform the applying operation, the liquid spreads evenly on the applying roller. Furthermore, the liquid on the applying roller can be appropriately collected in the liquid holding member.

Further features of the present invention will become apparent from the following description of exemplary embodiments with reference to the attached drawings.

DESCRIPTION OF THE EMBODIMENTS

An embodiment of the present invention will be described below with reference to the drawings.

The embodiment of the present invention relates to a hybrid machine composed of a document reading device and a printing apparatus based on an ink jet scheme. In particular, the embodiment relates to an ink jet printing apparatus including a liquid applying mechanism which, when a print medium is printed with ink composed of a pigment as a color material, applies the print medium with a liquid for a predetermined purpose such as promotion of cohesion of the pigment.

Figure 1:
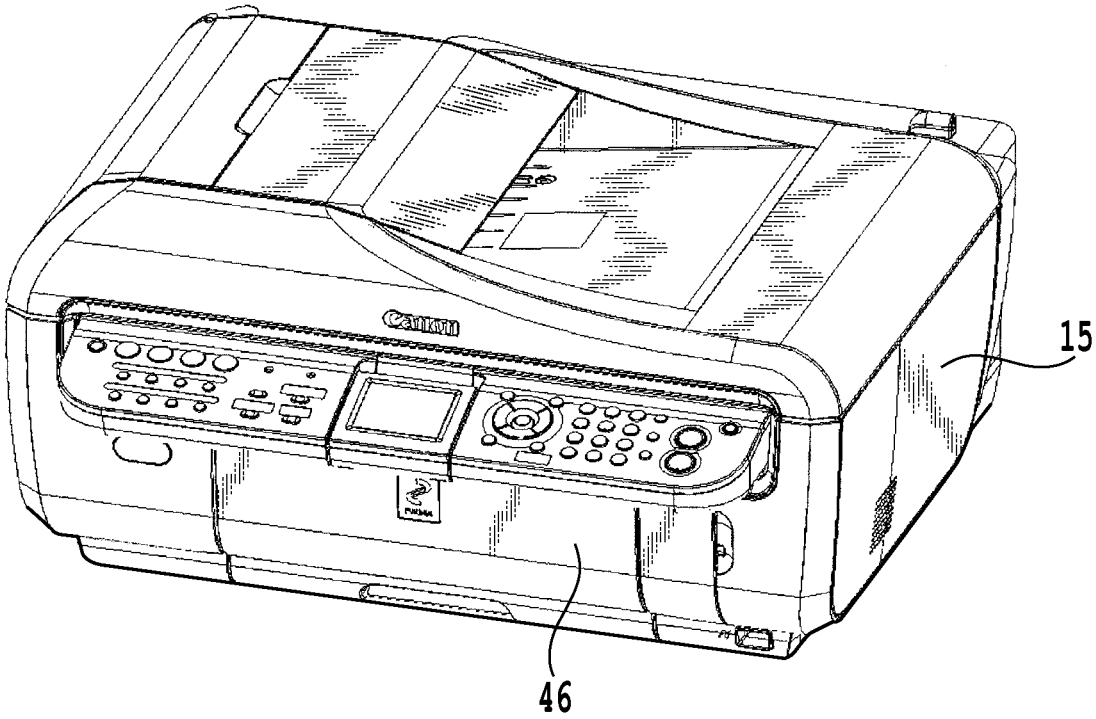
FIG. 1 is a perspective view showing an appearance of a hybrid machine using an ink jet printing apparatus according to an embodiment of the present invention.
Figure 2:
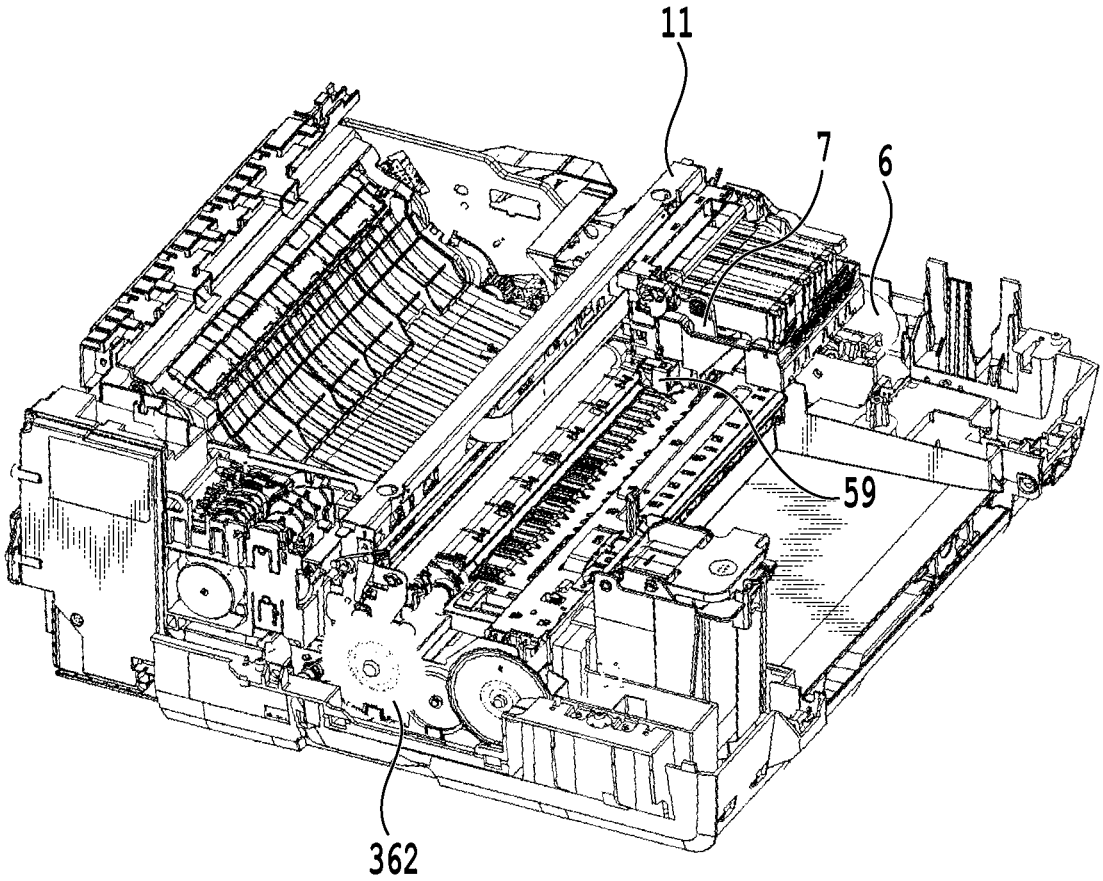
FIG. 2 is a perspective view of the hybrid machine shown in FIG. 1 and from which an outer case has been removed, the perspective view showing an internal configuration of the printing apparatus as viewed from front left.
Figure 3:
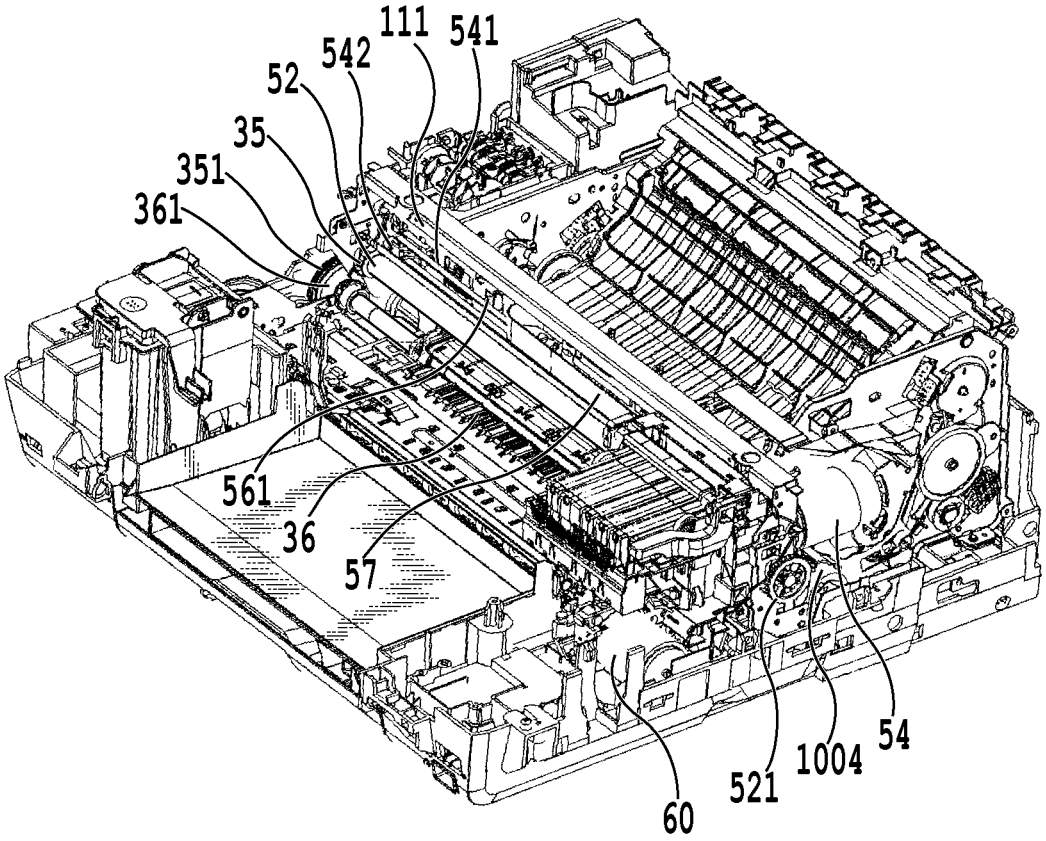
FIG. 3 is a perspective view of the hybrid machine shown in FIG. 1 and from which the outer case has been removed, the perspective view showing the internal configuration of the printing apparatus as viewed from front right.
Figure 4:
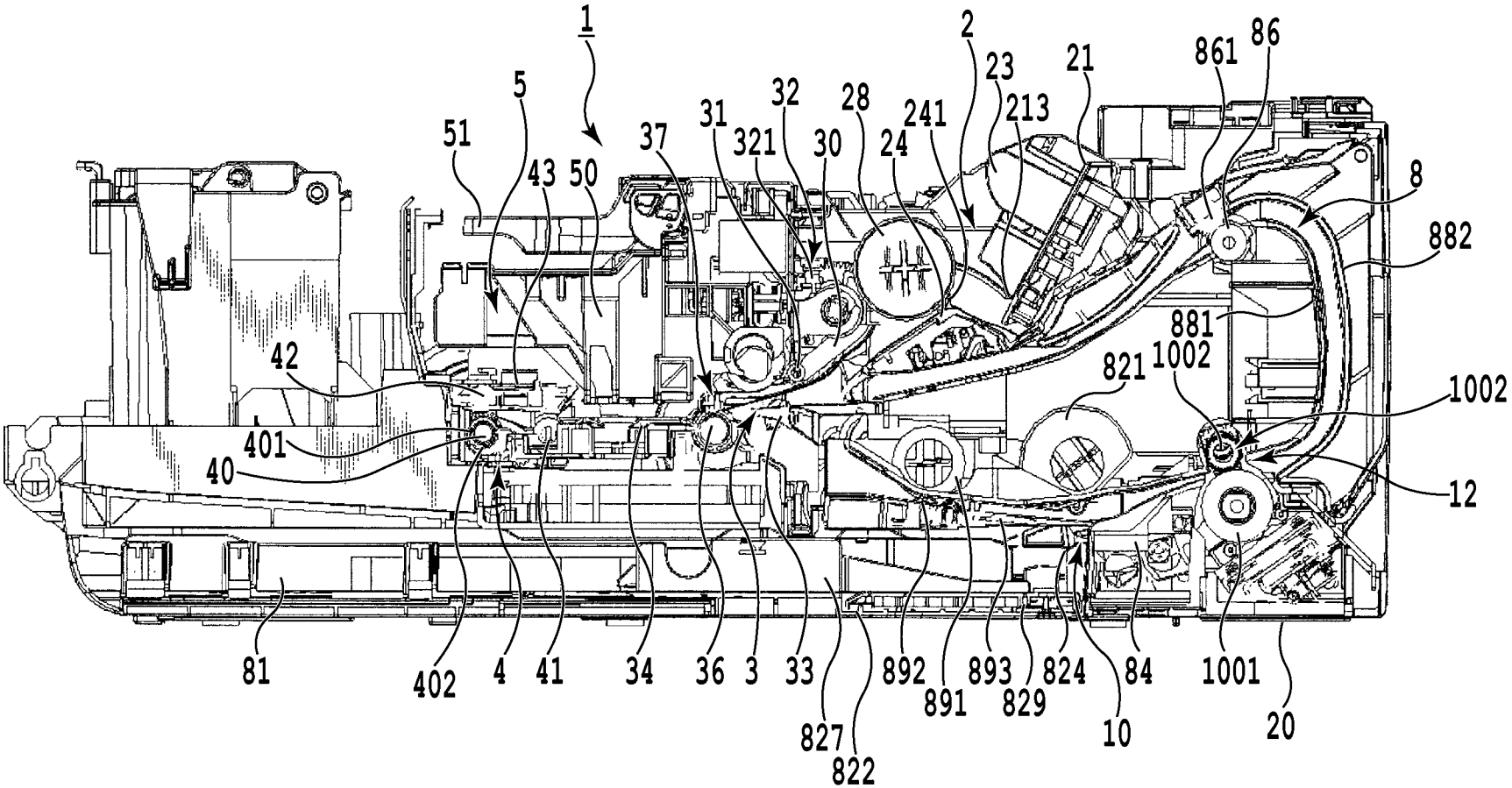
FIG. 4 is a vertical sectional view also showing the internal configuration of the printing apparatus.

FIG. 1 is a perspective view showing an appearance of the above-described hybrid machine. FIGS. 2 and 3 are perspective views of the hybrid machine shown in FIG. 1 and from which an outer case has been removed, the perspective views showing an internal configuration of the printing apparatus as viewed from front left and front right, respectively. FIG. 4 is a vertical sectional view also showing the internal configuration of the printing apparatus. In FIG. 1, roughly speaking, an outer portion 15 of the hybrid machine includes an outer case, an operation panel, and a sheet discharging tray 46, and contains the printing apparatus, described below.

As shown in FIGS. 2 to 4, the printing apparatus 1 includes an ASF sheet supply section 2, a sheet conveying section 3, a sheet discharging section 4, a carriage section 5, a recovery mechanism section (cleaning section) 6, a printing section based on a print head 7, and a U turn conveying section and double-side conveying section 8. The printing apparatus 1 includes an applying liquid channel and liquid circulating section 9, a cassette sheet supply section 10, and a liquid applying section 12, as an applying mechanism.

According to the present embodiment, sheets are fed from the ASF sheet supply section if dedicated paper for photographic image quality printing or the like. If ordinary paper typified by copy sheets is used, the sheets are fed from a cassette. This is because the dedicated paper is relatively thick, so that the sheets are fed from the ASF, which is a nearly straight path, in order to reduce a variation in load caused by the rigidity of the paper. On the other hand, for example, when the printing apparatus is used for business, ordinary paper is used, and it is assumed that a large number of sheets are frequently printed. Thus, in this case, the sheets are fed from the cassette, in which a large number of sheets can be set. In a printing operation, roughly speaking, a print sheet (print medium) fed from the ASF sheet supply section 2, which is a first sheet supply port, is conveyed by the sheet conveying section 3. In the meantime, the print head 7, installed in the carriage section 5, prints the sheet. Thereafter, the sheet is discharged to and stacked on the sheet discharging section 4, composed of a sheet discharging tray 46 integrated with a front cover. On the other hand, a print sheet fed from the cassette sheet supply section 10, which is a second sheet supply port, passes through the liquid applying section 12, the U turn conveying section and double-side conveying section 8, and the sheet conveying section 3. The sheet is printed by the print head 7 and then discharged to and stacked on the sheet discharging section 4. These mechanical sections will be sequentially described below in detail.

[ASF Sheet Supply Section]

The ASF sheet supply section 2 is composed of a pressure plate 21 on which print sheets are stacked, a sheet supply roller 28 that feeds the print sheets, a separating roller 241 that separates a sheet from the remaining sheets, a return lever that returns the print sheet to a stack position thereof, and the like; the pressure plate 21, the sheet supply roller 28, the separating roller 241, and the return lever are mounted on a base 20. Specifically, a sheet supply tray (not shown in the drawings) on which the stacked sheets are held is mounted on the base 20 or the outer portion 15. The sheet supply tray, which is a print medium stack section, includes multiple stages and is withdrawn for use. The sheet supply roller 28 is a bar-like member with a circular arc-like cross section and includes one piece of separating roller rubber provided near a sheet reference to allow the print sheet to be fed. A driving source for the sheet feeding roller 28 is a motor (hereinafter referred to as an AP motor) provided at the ASF sheet supply section 2. The AP motor is also a driving source for the recovery mechanism section 6, described below. A driving force of the motor is transmitted via a transmission gear and a planet gear to allow the sheet supply roller to be driven.

The pressure plate 21 is provided with a movable side guide 23 that regulates a position where the print sheets are stacked. The pressure plate 21 is rotatable around a rotating shaft provided on the base 20 and is biased toward the sheet supply roller 28 by a platen spring. An area of the pressure plate 21 which lies opposite the sheet supply roller 28 includes a separation sheet 213 made of a material such as synthetic leather which offers a large coefficient of friction in order to prevent a plurality of print sheets located near an uppermost stack layer from being conveyed with an overlapping state. The position of the pressure plate 21 can be changed by a platen cam so that the pressure plate 21 can abut against and separate from the sheet supply roller 28. A separating roller holder 24 holding a separating roller 241 is mounted on the base 20 so as to be rotatable around the rotating shaft. The separating roller 241 is biased toward the sheet supply roller 28 by a separating roller spring. A clutch spring is attached to the separating roller 241 so that application of a load of at least a predetermined value allows the separating roller 241 to rotate. The separating roller 241 is configured to abut against and separate from the sheet supply roller 28 by means of a separating roller release shaft and a control cam. The positions of the pressure plate 21, return lever, and separating roller 241, described above, are sensed by the ASF sensor. The return lever, used to return the print sheet to the stack position thereof, is rotatably mounted on the base 20. The return lever is biased in a release direction by a return lever spring. To return the print sheet to the stack section, the return lever is rotated by the control cam.

In a normal standby state, the pressure plate 21 is released by the platen cam, and the separating roller 241 is released by the control cam. Moreover, the return lever is located so as to return the print sheet to the stack section and to block a stack port to prevent the stacked print sheets from being shifted toward the interior. In this condition, when sheet supply is started, driving of the motor causes the separating roller 241 to abut against the sheet supply roller. The return lever is then released to cause the pressure plate 21 to abut against the sheet supply roller 28. In this condition, the print sheets start to be fed to the interior of the apparatus.

The number of sheets fed out by the sheet supply roller 28 is limited by a former-stage separation section provided on the base 20. Thus, only a predetermined number of print sheets are fed out to a nip portion between the sheet supply roller 28 and the separating roller 241. At the nip portion, the uppermost one of the fed-out print sheets is separated from the remaining print sheets and fed to the interior of the apparatus. When the print sheet reaches a position between a conveying roller 36 and a pinch roller 37, the pressure plate 21 is released by the platen cam. The separating roller 241 is released by the control cam. The return lever returns to a stack position where the return lever returns the print sheet to the stack section by means of the control cam. At this time, an extra print sheet (which is different from the uppermost print sheet) fed out to the vicinity of the nip portion between the sheet supply roller 28 and the separating roller 241 is returned to the original stack position.

[Cassette Sheet Supply Section]

The print sheets set in the cassette 81 are assumed to be ordinary print sheets such as copy paper. The cassette 81 includes a platen 822 on which the print sheets are stacked and which brings the print sheets into pressure contact with the sheet supply roller 821, in order to separate and feed one of the print sheets. A U turn base 84 forming the U turn conveying section and double-side conveying section 8 includes the sheet supply roller 821, the separating roller, a return lever 824 that returns the print sheet to the stack position thereof, and a control mechanism that controls the pressure contact and separation of the platen 822. The cassette 81 has a two-stage telescopic structure and can be used depending on the size of the print sheets. If small-sized sheets are stacked or the cassette is not used, the cassette 81 can be contracted and housed inside the outer section 15.

The sheet supply roller 821 is shaped like a bar with a circular arc-like cross section. One piece of sheet supply roller rubber is provided at a position near the sheet reference to allow the print sheet to be fed. The sheet supply roller 821 is driven by transmitting a driving force of a double-side conveying motor provided in the double-side conveying section 8, via a transmission gear, a planet gear, and the like. A movable guide side 827 is movably installed on the platen 822 to regulate the stack position of the print sheet. The platen 822 is rotatable around a rotating shaft coupled to the cassette 81. The platen 822 is biased toward the sheet supply roller 821 by a pressure contact and separation control mechanism provided between the platen 822 and the U turn base 84 and made up of a platen spring. An area of the platen 822 which lies opposite the sheet supply roller 821 includes a separation sheet 829 made of a material such as synthetic leather which offers a large coefficient of friction in order to prevent a plurality of print sheets located near the uppermost stack layer from being conveyed with the overlapping state. The platen 822 is configured to be able to abut against and separate from the sheet supply roller 821 by means of a platen cam.

The separating roller is rotatably supported on a separating roller holder that is pivotally movable around a shaft provided on a separation base. The separation roll holder is biased toward the sheet supply roller 821 by a separating roller spring. A clutch spring is attached to the separating roller so that application of a load of at least a predetermined value allows the separating roller to rotate. The separating roller 241 is configured to abut against and separate from the sheet supply roller 821 by means of a separating roller release shaft and a control cam. The positions of the platen 822, return lever 824, and separating roller 831 are sensed by a U turn sensor.

The return lever 824, used to return the print sheet to the stack position thereof, is mounted on the U turn base 84. The return lever is 824 biased in a release direction by a return lever spring. To return the print sheet, the return lever 824 is pivotally moved by the control cam. In a normal standby state, the platen 822 is released by the platen cam, and the separating roller is released by the control cam. The return lever 824 returns the print sheet to the stack position thereof. The return lever 824 is located so as to block a stack port to prevent the stacked print sheets from being shifted. In the standby condition, when sheet supply is started, driving of the motor causes the separating roller to abut against the sheet supply roller 821. The return lever 824 is then released to cause the platen 822 to abut against the sheet supply roller 821. In this condition, the print sheets start to be fed.

Movement of the print sheet is limited by a former-stage regulating unit provided on a separation base 83. Several sheets located in the uppermost layer are fed to the nip portion between the sheet supply roller 821 and the separating roller. At the nip portion, the uppermost one of the fed print sheets is separated from the remaining print sheets and then fed and conveyed. When the separated and conveyed print sheet reaches a position between a first U turn roller 86 and a first U turn pinch roller 861, the platen 822 is released by the platen cam. The separating roller is released by the control cam. The return lever 824 is returned to the stack position by the control cam. At this time, the other print sheets having reached the nip portion between the sheet supply roller 821 and the separating roller is returned to the stack position thereof.

A detailed description will be given later for the mechanism of the liquid applying section 12 according to the embodiment of the present invention, which applies the applying liquid on the print sheet fed from the above-described cassette sheet supply section 10.

[Sheet Feeding Section]

The sheet conveying section 3 is constructed using as a structure member a chassis 11 formed by bending a sheet metal material upward. Hat is, the sheet conveying section 3 includes the conveying roller 36 that conveys the print sheet and a PE (Paper End) sensor 32. The conveying roller 36 is composed of, for example, a metal shaft with a surface applied with fine powder of ceramics. Metal portions of the conveying roller 36, that is, the opposite ends thereof, are supported by a bearing provided on the chassis 11. To enable stable conveyance by applying a load for rotation to the conveying roller 36, a conveying roller tension spring is installed between the beating and the conveying roller 36. That is, a predetermined load is imposed on the conveying roller 36 by using the spring to bias the conveying roller 36.

A plurality of pinch rollers 37 are disposed so as to abut against the conveying roller 36. The pinch rollers 37 are held by a pinch roller holder 30 on which a pinch roller spring 31 exerts a bias force. Thus, the pinch rollers 37 bring the print sheet into pressure contact with the conveying roller 36 to exert a conveying force required to convey the print sheet. At this time, a rotating shaft of the pinch roller holder 30 is supported by the bearing of the chassis 11.

A guide flapper 33 and a platen 34 which guide the print sheet are disposed at an inlet of the sheet conveying section 3 to which the print sheet is conveyed. A PE sensor lever 321 is pivotally movably attached to the pinch roller holder 30 to notify the PE sensor 32 of detection of a leading end and a trailing end of the print sheet. The platen 34 is mounted on the chassis 11. The guide flapper 33 is supported so as to be rotatable around a shaft concentric with the bearing portion of the conveying roller 36. The guide flapper 33 is positioned by contacting against a part of the chassis 11.

In the above-described construction, the print sheet fed from the sheet supply section to the sheet conveying section 3 is guided by the pinch roller holder 30 and the guide flapper 33 and fed into the nip portion (LF nip portion) between the conveying roller 36 and the pinch roller 37. At this time, the leading end of the fed print sheet is sensed by the PE sensor lever 321. Thus, a print position of the print sheet in the printing section can be determined. The print sheet is conveyed on the platen 34 by rotationally driving the conveying roller 36 under the driving force of a conveying motor 35. A rib serving as a conveyance reference surface is formed on the platen 34. The rib allows a gap between the print head 7 and the print sheet to be managed and prevents, together with the sheet discharging section 4, the print sheet from being significantly corrugated. The conveying roller 36 is driven by transmitting a rotating force of the conveying motor 35, a DC motor, to a pulley 361 on a shaft of the conveying roller 36 via a timing belt 351. Furthermore, a code wheel 362 is attached to the shaft of the conveying roller 36; markings are formed on the code wheel 362 at a pitch of 150 to 300 lpi in order to detect the amount of conveyance by the conveying roller 36. An encoder sensor is mounted on the chassis 11 to read the code wheel 362.

[Carriage Section]

The carriage section 5 includes a carriage 50 that moves with the print head 7 mounted thereon. The carriage section enables scanning so as to allow the print head 7 to perform printing. The carriage 50 is guided and supported so as to be movable along a guide shaft 52 installed perpendicular to a conveying direction of the print sheet. A leading end of the carriage 50 is slidably supported by a guide rail 111 provided parallel to the guide shaft 52. The carriage 50 is held in a constant posture so as to maintain the gap between the print head 7 and the print sheet. The guide shaft 52 is attached to the chassis 11. The guide rail 111 is integrated with the chassis 11.

The carriage 50 is driven via a timing belt 541 by a carriage motor 54 mounted on the chassis 11. The timing belt 541 is extended with a predetermined tension applied thereto by an idle pulley 542. The timing belt 541 is coupled to the carriage 50 via a damper such as rubber. The damper attenuates vibration of the carriage motor 54 and the like to reduce unevenness of images and the like. A code strip 561 is located parallel to the timing belt 541; markings are formed on the code strip 561 at a pitch of 150 to 300 lpi to detect the position and movement of the carriage 50. An encoder sensor reading the markings is mounted on a carriage board on the carriage 50.

A contact is provided on the carriage board 92 for electric connection to the print head 7. A flexible flat cable 57 is connected to the carriage 50 to transmit a head driving signal and the like from an electric board to the print head 7 in the printing apparatus. The carriage 50 includes a contacting portion and a pressing unit for pressing and fixing the print head 7, in order to position the print head 7 on the carriage 50. The pressing unit is mounted on a head set lever 51 that is pivotally moved to press the print head 7.

Eccentric cams 521 are fixed to opposite ends of the guide shaft 52. The driving force of the AP motor is transmitted to the eccentric cams 521 via a gear train by a main cam of the recovery mechanism section 6. Thus, the guide shaft 52 can be elevated and lowered in the vertical direction. Consequently, the carriage 50 can be elevated and lowered to provide the optimum gap for a print sheet with a different thickness. The carriage 50 includes an automatic registration sensor 59 that allows automatic correction of a deviation in landing of ink ejected from the print head 7 and landing on the print sheet. The sensor 59 is a reflective type and can receive light reflected by an image pattern on a print medium P to determine an optimum registration value.

[Printing Section]

The print head 7 and ink tanks are removably mounted on the carriage 50; the print head 7 ejects ink based on print data, and ink to be supplied to the print head is stored in the ink tanks. The print head 7 includes five ejection port rows through which cyan (C) ink, magenta (M) ink, yellow (Y) ink, black (Bk) ink, and photo black (PBk) ink are ejected. Accordingly, five ink tanks are used in which the five color inks are stored. The five color inks are composed of respective pigments as color materials. For these pigment inks, a liquid described below in conjunction with the liquid applying section promotes cohesion of the pigments. Thus, density and the like can be improved to realize high quality, and image durability can also be enhanced.

Specifically, a plurality of ink channels coupled to the ink tanks for the respective ink colors are formed in the print head 7 and communicate with respective ink ejection ports. An ink ejecting actuator (energy generating element) is located inside each of a plurality of ejection ports forming each of the ejection port rows. In the present embodiment, the actuator utilizes a film boiling pressure of the liquid induced by an electro-thermal converter (heating element). The actuator is not limited to this aspect but may be a well-known one such as an electromechanical converter (electricity-pressure converting element), for example, a piezo element.

With the above-described configuration, when the print sheet is printed, the print sheet is conveyed to a row position (a position of the print sheet in the conveying direction) where an image is to be formed. Furthermore, the carriage 50 is moved to a print position in a main scanning direction by the carriage motor 54. Then, a CR (Carriage) encoder mounted on the carriage 50 reads the code strip 561 extended on the chassis. Thus, in response to an image signal from the electric board, the print head 7 can be driven to eject ink droplets of each color toward the print sheet at an appropriate timing. Once printing of one line is completed as described above, the sheet conveying section 3 conveys the print sheet by a required amount. This operation is repeated to allow an image to be printed on the print sheet.

[Sheet Discharging Section]

The sheet discharging section 4 includes two sheet discharging rollers 40 and 41, a spur 42 that abuts against the sheet discharging rollers 40 and 41 under a predetermined pressure, a gear train that transmits the driving force of the conveying roller 36 so as to utilize the driving force to drive the sheet discharging rollers 40 and 41. The sheet discharging rollers 40 and 41 are pivotally movably attached to the platen 34. The sheet discharging roller 40, located on a downstream side in the conveying direction, is composed of a metal shaft to which a plurality of rubber portions 401 are secured. Driving from the conveying roller 36 is transmitted to the sheet discharging roller 40 via an idler gear to drive two pairs of sheet discharging rollers. The sheet discharging roller 41, located on an upstream side in the conveying direction, is composed of a resin shaft to which a plurality of elastic bodies made of elastomer are secured. Driving force is transmitted from the sheet discharging roller 40 to the sheet discharging roller 41 via an idler gear.

The spur 42 is composed of a thin stainless plate including a plurality of protruding shapes around a periphery thereof and molded integrally with a resin portion. A plurality of the spurs 42 are attached to a spur holder 43. A spur spring made up of a bar-like coil spring is used to attach the spurs 42 to the spur holder 43 and to press the spurs 42 against the sheet discharging rollers 40 and 41. Some of the spurs 42 are provided at positions corresponding to the rubber portions 401 of the sheet discharging roller 40 and the elastic body portions of the sheet discharging roller 41. This mainly allows a conveying force to be exerted. The other spurs 42 are provided at positions where the rubber portions 401 of the sheet discharging roller 40 and the elastic body portions of the sheet discharging roller 41 are absent. This mainly inhibits the print sheet from rising.

A sheet end support is provided between the sheet discharging rollers 40 and 41 to raise the opposite ends of the print sheet so that the print sheet is held by tips of the sheet discharging rollers 40 and 41. This prevents a later discharged print sheet from rubbing against and damaging a print image on an earlier discharged print sheet. The sheet end support uses a sheet end support spring to bias a resin member with a roller provided at a tip thereof to press the roller against the print sheet under a predetermined pressure to flexibly raise the opposite ends of the print sheet.

With the above-described configuration, the print sheet with the image formed thereon by the printing section is conveyed so as to be held with a sandwiched state at the nip between the sheet discharging roller 41 and the spurs 42. The print sheet is thus discharged to the sheet discharging tray 46. The sheet discharging tray 46 can be housed in the front cover and is withdrawn for use. The sheet discharging tray 46 is configured to rise toward a leading end thereof and toward opposite ends thereof to more appropriately allow stacking of print sheets and prevention of rubbing of the image forming surface. A sheet discharging roller cleaner pivotally movably supported by a spring shaft is compressed against the rubber portions 401 of the sheet discharging roller 40. The sheet discharging roller cleaner 402 is composed of a cleaner section that moves in conjunction with the rubber portions 401 to remove foreign matter attached to or deposited on surfaces of the rubber portions and including paper powder, and a holder section that holds the cleaner section. The cleaner section is preferably made of porous urethane containing a large amount of fine bubbles of size about 50 to 200 μm.

[Recovery Mechanism Section]

The recovery mechanism section 6 includes a pump 60 that, for example, sucks ink through the ejection ports in the print head 7, a cap that inhibits possible drying of the vicinity of the ejection ports in the print head 7, and a wiper that wipes and cleans the periphery of the ejection ports in the print head 7. These mechanisms allow ink ejection performance of the print head 7 to be maintained and recovered. In the present embodiment, the recovery mechanism section 6 is principally driven by the driving force of the AP motor, which is a driving source for the ASF sheet supply section 2, described above. Specifically, one way clutch is provided such that the pump 60 is operated by rotation of the AP motor in one direction, whereas a wiping operation of the wiper and a tightly contacting and separating operation of the cap are performed by rotation of the AP motor in the opposite direction.

The pump 60 may be, for example, a tube pump. In the case of the tube pump, the pump 60 is configured to generate negative pressure by using a pump skid to squeeze two tubes. The cap and the pump 60 are connected together via an on-off valve or the like. By operating the pump 60 with the cap tightly contacted with the print head (capping condition), ink and sticking ink or ink containing bubbles or the like can be sucked and removed through the ejection ports in the print head. A cap absorber is provided inside the cap to remove ink remaining on an ejection port surface after the suction. Furthermore, by operating the pump 60 with the cap open to suck the ink remaining in the cap, the ink remaining in the cap absorber is removed and prevented from being stuck to the absorber. The ink sucked by the pump 60 is sucked and held in a waste ink absorber installed on the base 20.

A series of operations such as the wiping operation of the wiper and the capping operation of the cap are controlled by a main cam with a plurality of cams. That is, the main can acts on cams and arms in the respective areas to perform the predetermined operations at predetermined timings. The position of the main cam can be detected by a position detecting sensor such as a photo interrupter. When the cap is separated from the print head, the wiper is slidably contacted with the ejection port surface to wipe (clean) the ejection port surface. In the present embodiment, the wiper is composed of a plurality of wipers including those which wipe the vicinity of the ejection ports and those which wipe the entire ejection port surface including a peripheral portion of the ejection ports. Upon moving to an innermost position in a winding direction, each of the wipers abuts against a wiper cleaner so as to have ink or the like adhering to the wiper removed (cleaned).

An opening and closing driving force for the on-off valves between the cap and the pump 60 is transmitted and controlled by the sheet discharging roller 40. Selecting one of the on-off valves to be driven allows batch suction of all color inks to be associated with individual suction of each color ink as required. An open position and a closed position of each of the on-off valves are sensed by a valve position detecting sensor.

Now, description will be given of operation of the liquid applying section 12 and the U turn conveying section and double-side conveying section 8, located downstream of the liquid applying section 12, which operations are performed when an operation of feeding a sheet from the cassette is carried out.

The liquid applying section 12 for liquid applying is provided downstream in the direction in which the print sheet is fed from the cassette sheet supply section 10. A U turn conveying path is provided downstream of the liquid applying section 12. When the fed print sheet passes through the liquid applying section 12, the liquid is applied on a print surface of the print sheet. Thereafter, the applied print sheet is conveyed to the sheet conveying section 3 through the U turn conveying section 8. The U turn conveying scion also includes the double-side conveying section 8 for back side printing as described below. Thus, after the front surface is printed, the print sheet is conveyed through the double-side conveying section and passes through the liquid applying section 12 again. The liquid is then applied on a back surface of the print sheet again. The print sheet is then conveyed to the sheet conveying section 3.

[Liquid Applying Section]

Roughly speaking, the liquid applying section 12 includes a liquid applying mechanism that applies a predetermined applying liquid on an applying medium and a liquid supply mechanism that supplies the applying liquid to the liquid applying mechanism.

Figure 5:
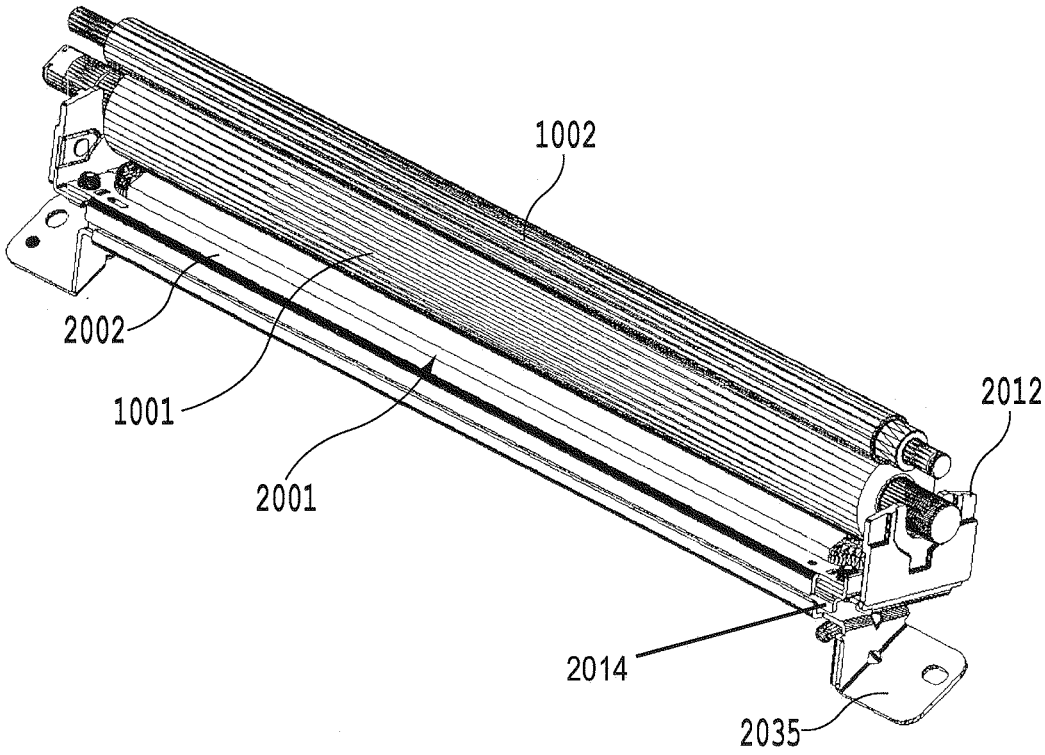
FIG. 5 is a perspective view showing a liquid applying mechanism in the hybrid machine shown in FIG. 1.
Figure 6:
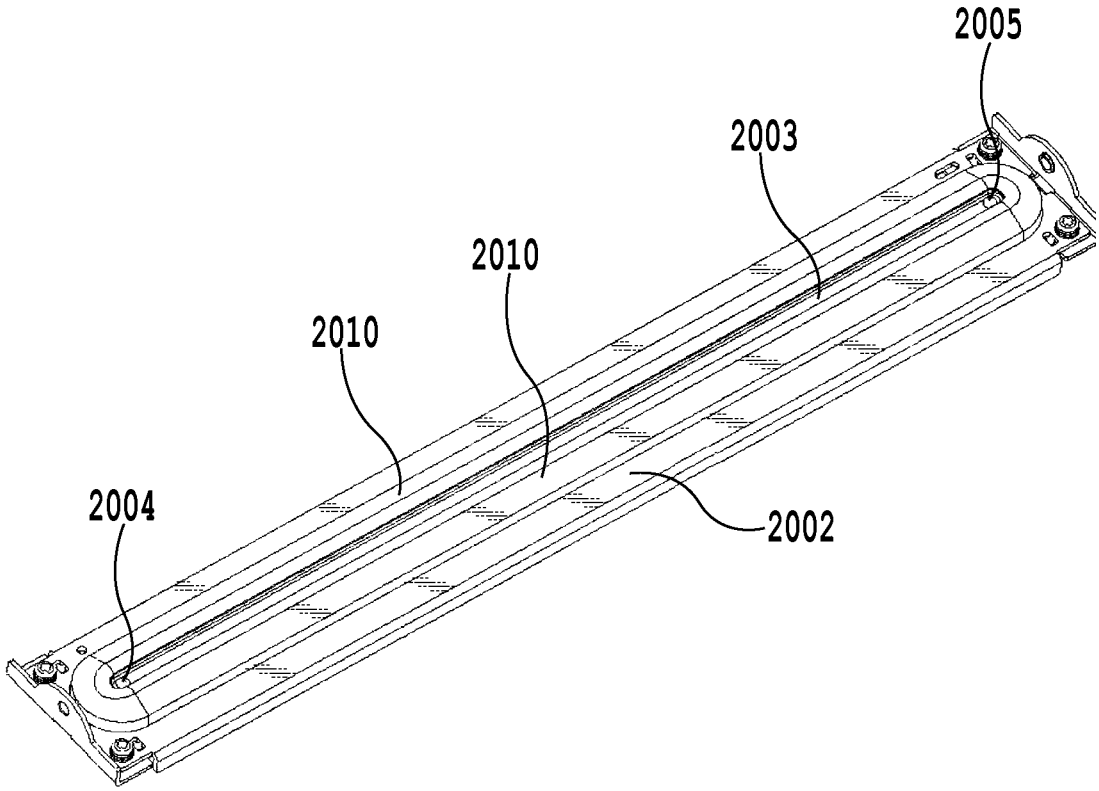
FIG. 6 is a perspective view showing a liquid holding mechanism making up the liquid applying mechanism shown in FIG. 1.

FIG. 5 is a perspective view showing the liquid applying mechanism. FIG. 6 is a perspective view showing a liquid holding member constituting the liquid applying mechanism. As shown in the figures, the liquid applying mechanism includes a cylindrical applying roller 1001. The applying roller 1001 contacts with a contacting portion of the liquid holding member 2001 to form a liquid holding space. The applying liquid in the liquid holding space spreads all over the peripheral surface of the applying roller in conjunction with rotation of the applying roller 1001. The applying liquid is applied on the surface of the print sheet. The applying liquid promotes coagulation of the pigment inks of the respective colors as described above. A cylindrical counter roller 1002 is located opposite the applying roller 1001 and biased toward the applying roller 1001 by a bias mechanism such as a spring described below with reference to FIG. 8. This enables the counter roller 1002 to contact with the applying roller 1001. When the applying roller 1001 is driven by a driving mechanism (not shown in the drawing) to rotate and the counter roller 1002 rotates in conjunction with the rotating applying roller 1001, the print sheet is conveyed so as to be held with the sandwiched state at the nip portion between the rollers. Thus, the print sheet is applied with the applying liquid. The driving mechanism for the applying roller 1001 is composed of a roller driving motor, and a power transmission mechanism with a gear train that transmits a diving force of the roller driving motor to the applying roller 1001.

The liquid holding member 2001 is formed by an contacting member 2010 being mounted on a cap sheet metal 2002 as two parallel straight portions and circumferential portions connecting the straight portions. A recess portion 2003 is formed in a central portion of an area inside the contacting portion 2010 so as to make up the liquid holding space. The applying roller 1001 is composed of silicone-containing rubber material as described below. A rubber portion of the contacting member 2010 is composed of an EPDM-containing rubber material. Thus, with no applying liquid present, when the applying roller 1001 abuts directly against the rubber portion of the contacting member 2010 and an attempt is made to rotate the applying roller, a very high sliding load may be generated to preclude the roller driving motor from rotating. To prevent this, a sheet made of a material such as PTFE which offers a small coefficient of friction is bonded to the rubber portion of the contacting member 2010 by integral molding. More specifically, the liquid holding member 2001 is composed of the cap sheet metal 2002 and the contacting member 2010, constructed integrally with the cap sheet metal 2002. That is, the straight portions of the contacting member 2010 are secured to the cap sheet metal 2002 along an upper edge of the recess portion 2003. The circumferential portion is secured to the cap sheet metal 2002 so as to extend from the upper edge through a bottom portion to an opposite lower edge. Thus, upon contacting against the applying roller 1001, the contacting member 2010 of the liquid holding member 2001 can comply with the peripheral shape of the applying roller.

Each of the applying roller 1001 and the counter roller 1002 is pivotally movably supported by parallel shafts the both ends of which are pivotally movably attached to frames (not shown in the drawing). The liquid holding member 2001 extends substantially all along the applying roller 1001 in a longitudinal direction thereof. As described below with reference to FIG. 8 and other figures, the cap sheet metal 2002, integrated with the liquid holding member 2001, is movable with respect to a cap stay 2035. Thus, the liquid holding member 2001 can be allowed to contact with and separate from the applying roller under a bias force. The recess portion 2003 of the liquid holding member 2001 includes a liquid supply port 2004 through which the liquid supply mechanism feeds the liquid (applying liquid) into the liquid holding space, and a liquid collection port through which the liquid is discharged from the interior of the liquid holding space.

Figure 7:
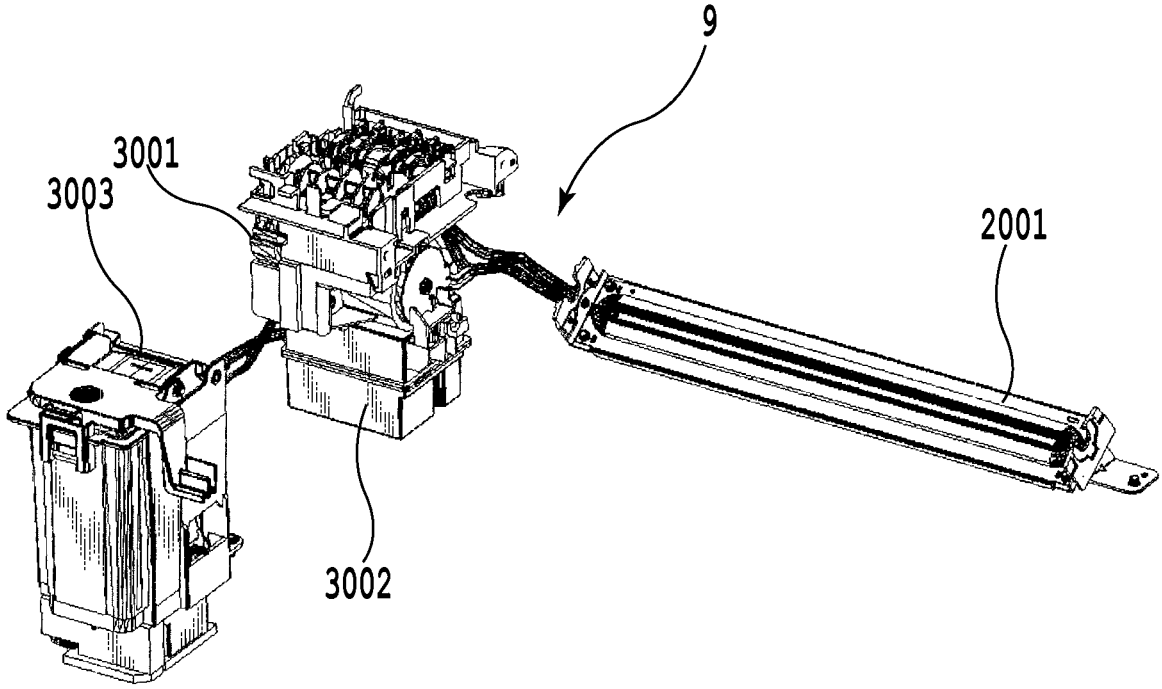
FIG. 7 is a view illustrating a liquid supply mechanism of the liquid applying mechanism in the hybrid machine shown in FIG. 1.

FIG. 7 is a diagram illustrating the liquid supply mechanism. The liquid supply mechanism includes the liquid holding space formed with the peripheral surface of the applying roller 1001 and the liquid holding member 2001, as a part of the liquid supply mechanism. The liquid supply mechanism includes a liquid supply pump motor 3001 that feeds the liquid into the liquid holding space, a buffer tank 3002, a main tank 3003, and the applying liquid paths and liquid circulating section 9, which connects these sections together.

Figure 8:
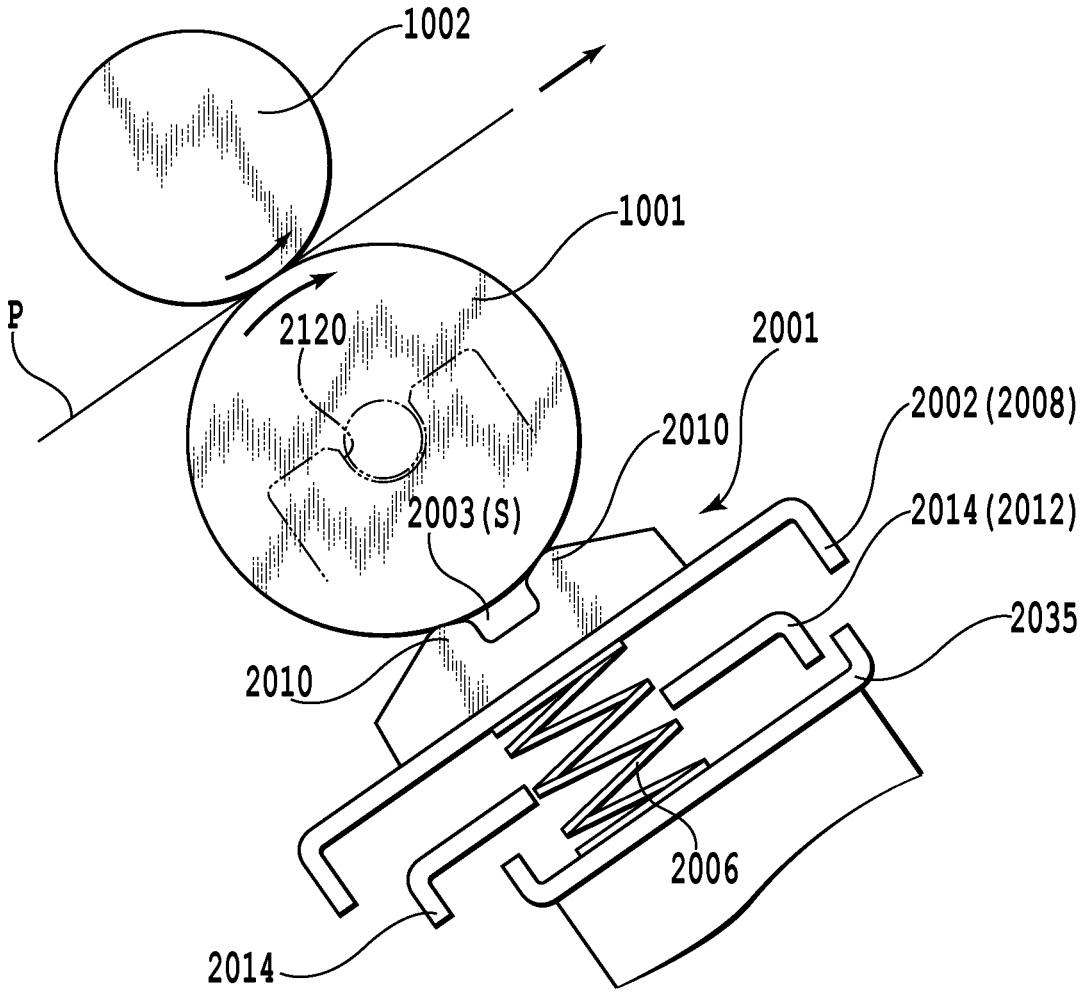
FIG. 8 is a schematic sectional view illustrating a mechanism provided in the liquid applying mechanism according to the embodiment of the present invention to mainly bias the liquid holding member toward a applying roller, as well as operation of the liquid holding member associated with the biasing.
Figure 9:
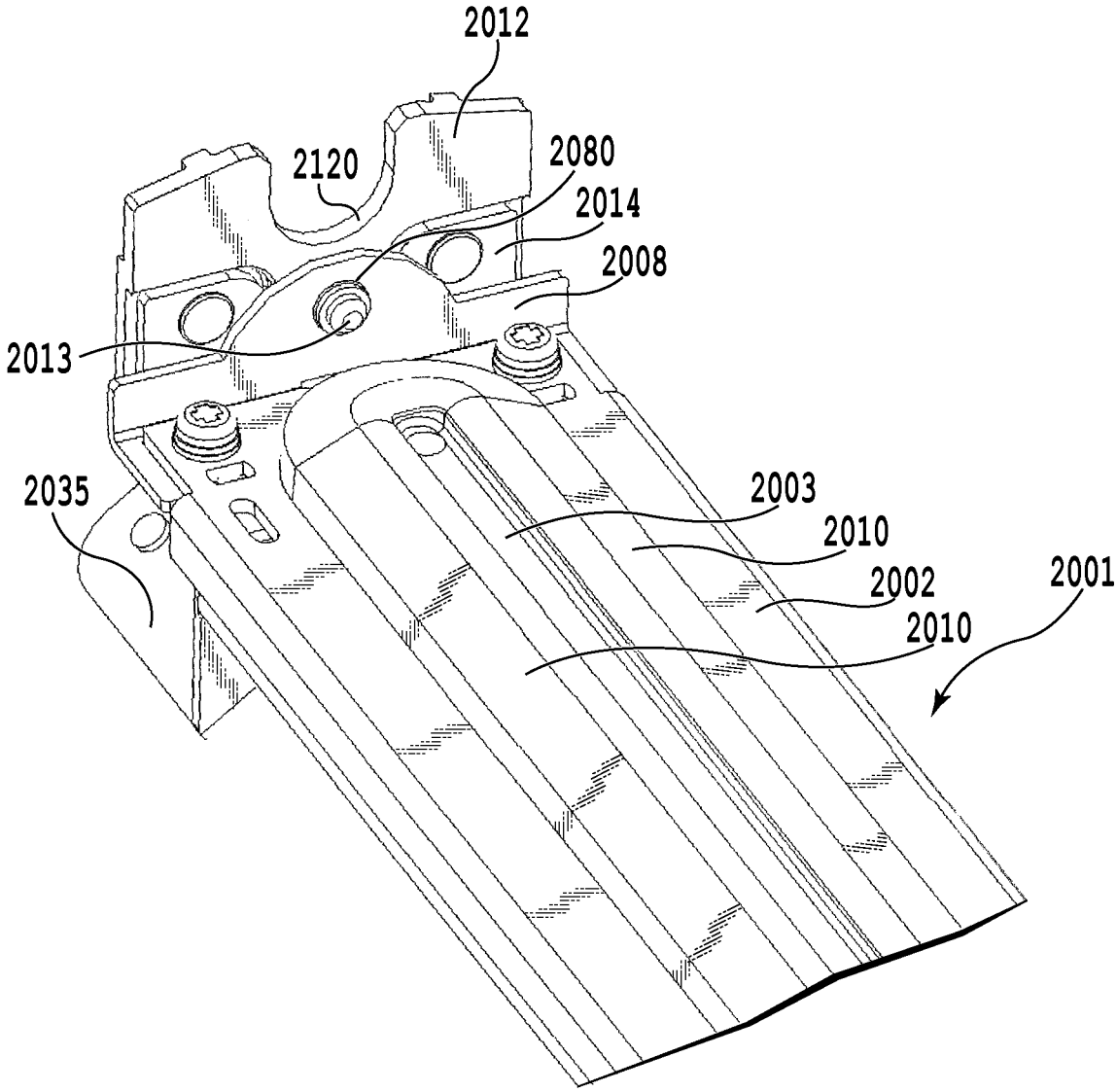
FIG. 9 is a perspective view showing a structure relating to the above-described operation.

FIG. 8 is a schematic sectional view mainly illustrating a mechanism that biases the liquid holding member 2001 toward the applying roller 1001, and operation of the liquid holding member associated with the biasing. FIG. 9 is a perspective view showing a structure relating to the above operation.

As shown in FIG. 8, the counter roller 1002 is biased toward the peripheral surface of the applying roller 1001 by a pressing mechanism (not shown in the drawings) including a spring. In this condition, the applying roller 1001 is rotated clockwise in FIG. 8 to convey the print sheet P to be applied with the applying liquid, in the direction of an arrow in the figure, so as to be in a sandwiched state between the counter roller 1002 and the applying roller 1001. The conveyance allows the applying liquid in the liquid holding space S to adhere to the peripheral surface of the applying roller 1001. Furthermore, the adhered applying liquid is transferred to the surface of the print sheet P. In the present embodiment, the applying roller 1001 is composed of a silicone-containing material with a rubber hardness of 20 degrees. The applying roller 1001 is about Ra 1.0 to 2.0 μm in surface roughness and 23.169 mm in diameter. The counter roller 1002 is composed of an iron material and is 12 mm in diameter.

On the other hand, the liquid holding member 2001 is biased toward the peripheral surface of the applying roller 1001 by a pressing mechanism with a spring 2006 so as to contact with the peripheral surface. Thus, the elongate liquid holding space S can be formed, which extends substantially all over the area applied with the liquid by the applying roller 1001. The applying liquid is fed into the liquid holding space S through the applying liquid path and liquid circulating section 9. Furthermore, the applying liquid is discharged from the liquid holding space S.

More specifically, the contacting member 2010 of the liquid holding member 2001, which is integrally and seamlessly formed, contacts closely and continuously with the outer peripheral surface of the applying roller 1001 by an elastic force of the spring 2006. As a result, the liquid holding space S is substantially closed by the contacting member 2010 and the outer peripheral surface of the applying roller 1001 so that the applying liquid is held in the space S. With rotation of the applying roller 1001 stopped, the contacting member 2010 and the outer peripheral surface of the applying roller are maintained in a liquid tight condition. This enables the liquid to be prevented from leaking to the exterior. On the other hand, with the applying roller 1001 rotating, the applying liquid slips through a gap between the outer peripheral surface of the applying roller 1001 and the contacting member 2010. The applying liquid then adheres to the outer peripheral surface of the applying roller in a layer. Here, the condition in which the outer peripheral surface of the stopped applying roller 1001 is in tight contact with the contacting member 2010 means that the liquid in the liquid holding space S is prevented from leaking to the exterior as described above. However, in this case, the contacting condition of the contacting member 2010 includes not only a condition in which the contacting member 2010 directly contacts the outer peripheral surface of the applying roller 1001 but also a condition in which the contacting member 2010 contact with the outer peripheral surface via a liquid film formed by a capillary force. Longitudinally laterally opposite portions of the contacting member 2010 are gently curved as viewed either in a planar direction or sideward. Thus, even when the contacting member 2010 is caused to abut against the applying roller 1001 under a relatively strong pressing force, the contacting member 2010 is entirely elastically deformed substantially evenly. The contacting member 2010 is thus prevented from being locally significantly distorted. As a result, the contacting member 2010 can abut closely and continuously against the outer peripheral surface of the applying roller 1001 to form the above-described substantially closed space.

As shown in FIG. 6, in the cap sheet metal 2002, the liquid supply port 2004 and the liquid collection port 2005 are formed in the recess portion 2003, surrounded by the contacting member 2010; the liquid supply port 2004 and the liquid collection port 2005 include holes penetrating the cap sheet metal 2002. The liquid supply port 2004 and the liquid collection port 2005 communicate with cylindrical coupling portions projecting from a back surface of the cap sheet metal 2002. The coupling portions are coupled to the applying liquid path and liquid circulating section 9. In the present embodiment, the liquid supply port 2004 is formed in the vicinity of one end (in FIG. 6, a left end) of the recess portion 2003, surrounded by the contacting member 2010. The liquid collection port 2005 is formed in the vicinity of the other end (in FIG. 6, a right end) of the recess portion 2003. The liquid supply port 2004 allows the applying liquid from the applying liquid path and liquid circulating section 9 to be fed to the liquid holding space S. The liquid collection port 2005 allows the liquid in the liquid holding space S to flow out to the applying liquid path and liquid circulating section 9. The feeding and outflow of the liquid allows the applying liquid in the liquid holding space S to flow from the left end to right end of the space S.

As shown in FIGS. 8 and 9, the cap sheet metal 2002, integrated with the liquid holding member 2001, is fixed at each of opposite ends thereof to a pivot sheet metal 2008 with screws, with the position in the conveying direction of the print sheet adjusted. On the other hand, cap arms 2012 also provided at the opposite ends of the liquid holding member 2001 each includes a U-shaped groove 2120. The U-shaped groove 2120 can receive the rotating shaft of the applying roller 1001 to accurately set the position of the applying roller 1001. The cap arms 2012, provided at the opposite ends of the liquid holding member 2001, are each fixed to a side surface of a channel-shaped arm stay 2014 by means of thermal welding. Thus, the cap arms 2012 at the opposite ends operate integrally with the arm stay 2014.

In the above-described structure, the pivot sheet metal 2008 includes an engagement hole 2080. The cap arm 2012 is provided with a fitting shaft 2013 fitted in the engagement hole 2080. Thus, the liquid holding member 2001, integrated with the pivot sheet metal 2008, can be pivotally moved with respect to the cap arm 2012 as a support member, using the fitting shaft 2013 as a pivotal axis. On the other hand, the cap stay 2035 is fixed to an apparatus frame parallel to the center shaft of the applying roller 1001. The spring 2006, making up the pressing mechanism, is provided on the cap stay to bias the cap sheet metal 2002 of the liquid holding member 2001 from the back surface thereof toward the applying roller.

As is apparent from the above description, the cap sheet metal 2002 (and the pivot sheet metal 2008) is configured to be able to move linearly with the cap arm 2012 (and the arm stay 2014) through engagement between the engagement hole 2080 and the fitting shaft 2013. Thus, in response to the bias force of the spring 2006, the cap sheet metal 2002 (and the pivot sheet metal 2008) and the cap arm 2012 (and the arm stay 2014) can move together. Furthermore, the cap sheet metal 2002 (and the pivot sheet metal 2008) can move pivotally with respect to the cap arm 2012 (and the arm stay 2014) using the fitting shaft 2013, which engages with the engagement hole 2080, as a pivotal shaft.

With the above-described relative operational relationship, even if, for example, the direction of the biasing toward the applying roller 1001 deviates or the positional relationship with the applying roller 1001 deviates slightly, the liquid holding member 2001 can move depending on the deviation. More specifically, even with the deviation, the liquid holding member 2001 moves in the bias direction and pivots depending on the deviation. Thus, the contacting pressure of the contacting portion 2010 on the applying roller can be made uniform. As a result, while the applying roller 1001 is stopped or during the applying operation, the uniform closed condition can be realized, and leakage of the applying liquid from the liquid holding space S can be prevented or reduced for purposes other than the applying. At the same time, the liquid can be inhibited from being evaporated.

Moreover, the present embodiment appropriately sets the positional relationship of the fitting shaft 2013 of the cap arm 2012 with respect to the contacting member 2010 of the liquid holding member. This allows improvement of the capability of the applying roller that applies the applying liquid on the print sheet as well as the capability of collecting the applying liquid remaining on the applying liquid, in the liquid holding space. This will be described below.

Figure 10:
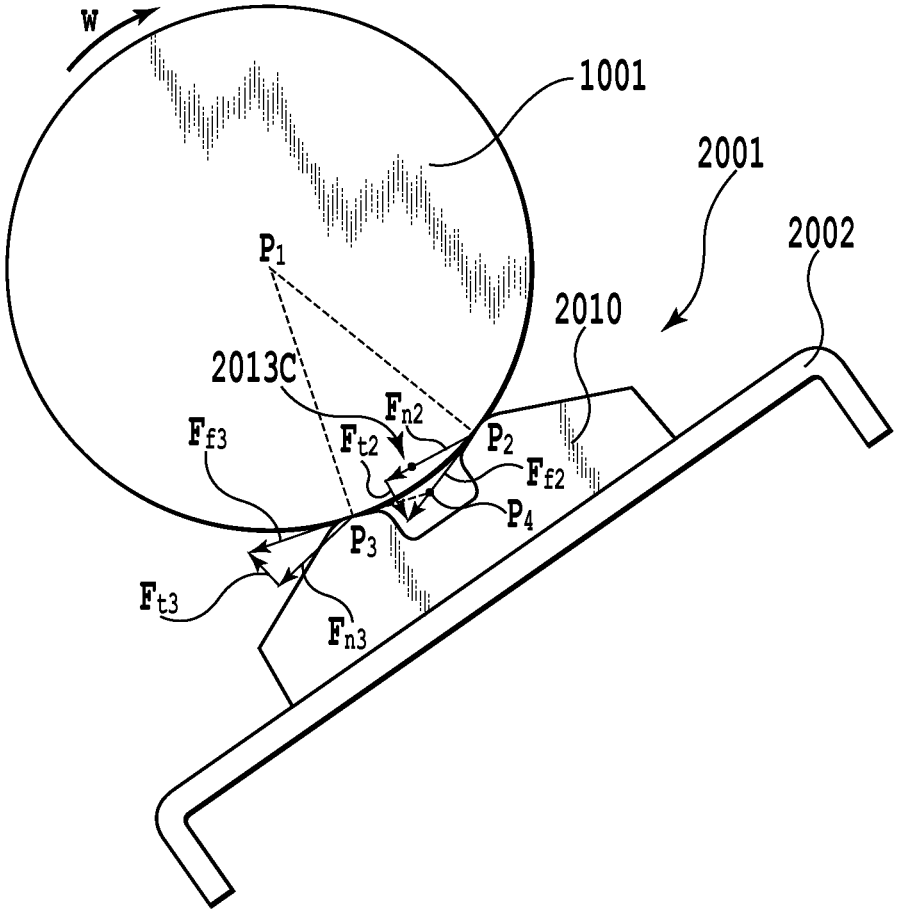
FIG. 10 is a diagram illustrating a positional relationship of a fitting shaft of a cap arm with an contacting member of the liquid holding member, the cap arm and the liquid holding member being provided in the liquid applying mechanism according to the embodiment of the present invention.
Figure 11:
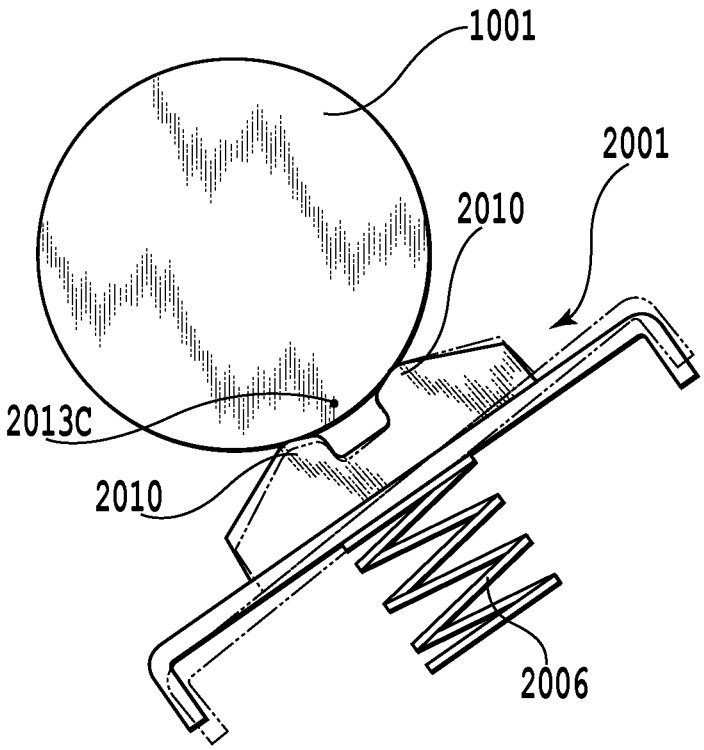
FIG. 11 is a diagram illustrating behavior of the liquid holding member of the liquid applying mechanism which results from rotation of the applying roller.

FIG. 10 illustrates the above-described positional relationship. In FIG. 10, P1 denotes the center of the applying roller 1001, P2 denotes a tangent point between the applying roller 1001 and a side (hereinafter referred to as an upstream side) of the contacting member 2010 on which the applying roller enters the liquid holding space in a rotating direction of the applying roller, P3 denotes a tangent point between the applying roller 1001 and a side (hereinafter referred to as a downstream side) of the contacting member 2010 on which the applying roller exits the liquid holding space in the rotating direction of the applying roller, and P4 denotes an intersecting point between a contour tangent line of the applying roller 1001 passing through the point P2 and a contour tangent line of the applying roller 1001 passing through the point P3.

In the present embodiment, the center 2013C of the fitting shaft 2013 is located inside a quadrangle P1P2P4P3 formed by the above-described four points. In other words, the position of the fitting shaft 2013 in the cap arm 2012 is determined taking into account the diameter of the applying roller 1001, the shape of the contacting portion 2010 of the cap sheet metal 2002, and the like.

Specifically, on the downstream side of the contacting member of the liquid holding member, the liquid desirably adheres to the surface of the applying roller 1001 in a thin and uniform film form. To achieve this, the pressure contact force between the applying roller 1001 and the contacting member 2010 needs to be set to be stably high in spite of a force acting on the liquid holding member 2001 to start rotating the liquid holding member 2001 during rotation of the applying roller 1001. On the other hand, on the upstream side of the contacting member, the pressure contact force between the contacting member 2010 and the applying roller 1001 is desirably reduced to facilitate collection of the liquid.

As shown in FIG. 10, when the applying roller 1001 rotates in a direction w in the figure, a friction force Ff3 is caused in a tangential direction of the applying roller 1001, at the downstream tangent point P3 between the applying roller 1001 and the contacting member 2010 of the liquid holding member 2001 and acts on the liquid holding member. The frictional force can be decomposed into a component force Fn3 acting in the direction of a line connecting the fitting shaft axis 2013C and the tangent point P3 and a component force Ft3 acting in a direction perpendicular to the component force Fn3. The component force Fn3 passing through the fitting shaft axis 2013C is canceled by reaction force provided by the fitting shaft 2013 of the cap arm 2012. Consequently, the behavior of the liquid holding member 2001 depends on the component force Ft3. Here, if the axis 2013C of the fitting shaft 2013 is located inside the quadrangle P1P2P4P3 as described above, the component force Ft3 acts in the direction in which the liquid holding member 2001 is tightly contacted with the applying roller 1001. As a result, at the downstream contact point of the contacting member, the pressing contact force between the applying roller 1001 and the contacting member 2010 is stably increased to allow the liquid to be deposited in an even and thin film form.

On the other hand, at the upstream tangent point P2, a frictional force Ff2 is exerted in the tangential direction. The frictional force can be decomposed into a component force Fn2 acting in the direction of a line connecting the fitting shaft axis 2013C and the tangent point P2 and a component force Ft2 acting in a direction perpendicular to the component force Fn2. Thus, for the same reason as described above, the behavior of the liquid holding member 2001 depends on the component force Ft2. Here, if the center 2013C of the fitting shaft 2013 is located inside the quadrangle P1P2P4P3 as described above, the component force Ft2 at the tangent point P2 acts in the direction in which the liquid holding member 2001 leaves the applying roller 1001. As a result, at the upstream contact point of the contacting member, the pressing contact force between the applying roller 1001 and the contacting member 2010 is weakened to facilitate collection of the liquid.

Even if the applying roller rotates in a direction opposite to the sheet conveying direction, the same effect as that described above can be exerted provided that the relationship is maintained in which the axis 2013C of the fitting shaft 2013 is located inside the quadrangle P1P2P4P3 as described above. That is, at the tangent point on the side on which the liquid leaves the liquid holding space, the force acts in the direction in which the applying roller 1001 and the liquid holding member 2001 tightly contact each other. At the tangent point on the side on which the liquid is collected in the liquid holding space, the force acts in the direction in which the pressure contact force is weakened.

[U Turn Sheet Feeding Section and Double-Side Conveying Section]

Referring back to FIG. 4, a conveying roller made up of the first U turn roller 86 and a first U turn pinch roller 861 is disposed on the downstream side of the liquid applying section 12. The U turn roller 86 is configured such that EPDM with a rubber hardness of 40 to 80 degrees is attached to a core metal of a metal shaft at four to six points. The pinch rollers 861 are arranged at positions corresponding to the rubber portions in order to sandwich the print sheet between the rollers. The pinch rollers 861 are attached to a spring shaft and thus biased toward the U turn roller 86. An inner guide 881 forming an inner surface and an outer guide 882 forming an outer surface are arranged so as to form a U turn conveying path.

A guide flapper 33 for switching forms a junction between a conveying path from the sheet supply section (ASF sheet supply section) and a conveying path from the double-side conveying section or U turn conveying section 8. The guide flapper 33 is configured to allow the two conveying paths to join together smoothly. When the print sheet conveyed from the ASF sheet supply section 2 or the double side conveying section 8 reaches the conveying roller 36, the leading end of the print sheet abuts against the nip portion between the conveying roller 36 and pinch roller 37, which are stopped. A registration operation (skew correction and head search) is then performed. Thereafter, as described above, the print head 7 prints the print sheet conveyed by the conveying roller 36.

To print the back surface of the print sheet with the front surface thereof already printed, the print sheet is turned upside down and conveyed again between the conveying roller 36 and the pinch roller 37 so that the trailing end of the print sheet first passes through. This opposite conveyance is performed by reversely rotating the sheet discharging rollers 40 and 41. In this case, the pinch roller 37 has been elevated by an elevating and lowering mechanism (not shown in the drawings) so as to leave the conveying roller 36, and the print sheet is fed between the pinch roller 37 and conveying roller 36 separated from each other. The print sheet can thus be conveyed smoothly. The print sheet is fed again into the double side conveying section 8, for which the guide flapper 33 forms an introduction section. The print sheet is then sandwiched between the double-side conveying roller 891 and the double-side pinch roller 892 and conveyed along a double side conveying path.

Then, the print sheet is conveyed while being guided by, for example, a guide member (flapper member) 893 set at a position where the guide member blocks a U turn sheet supply path forming the double side conveying path and ensures the double side conveying path between the guide member and the sheet supply roller 821. On the double side conveying path for back surface printing, upon being conveyed by a predetermined amount, the print sheet reaches the applying roller 1001 and U turn roller 86 in the applying mechanism section, described above. That is, the double side conveying path joins to the above-described U turn conveying path, which is also a part of the double side conveying path. Thus, for a succeeding applying and conveying path along which the print sheet is subsequently conveyed by the applying roller 1001 and the U turn roller 86, the configuration of the path and the operation on the path are the same as those in the case of the U turn conveyance by the applying roller 1001 and the U turn roller 86, described above.

The above-described embodiment relates to the liquid applying mechanism provided in the ink jet printing apparatus. However, of course, the application of the present invention is not limited to this form. For example, the present invention may be in a form of a device (liquid applying device) dedicated to liquid applying. A sheet may be manufactured by using the device to apply a liquid on the sheet and thereafter used according to the purpose of the liquid applying. Furthermore, the color material is not limited to the pigment but may be, for example, ink composed of a dye. In this case, a liquid that insolubilizes the dye may be used as an applying liquid.

Moreover, in the above description, in the form of the ink jet printing apparatus, the liquid applying mechanism is located on the upstream side of the printing section based on the ink jet scheme to eject ink to the print sheet with the liquid already applied thereon. However, the application of the present invention is not limited to this form. The present invention may be in a form in which liquid applying mechanism is located on the downstream side of the printing section to eject the liquid to the print sheet already printed with the ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-013067, filed Jan. 23, 2008, which is hereby incorporated by reference herein in its entirety.

What is claimed is:

1. An ink jet printing apparatus, comprising:

an applying roller that applies a liquid to a medium while being rotated;

a print head that ejects ink to the medium;

a liquid holding member that contacts the applying roller to form a liquid holding space between the liquid holding member and a peripheral surface of the applying roller;

a bias unit for biasing the liquid holding member towards the applying roller to cause the liquid holding member to contact the applying roller; and a support unit comprising a pivotal shaft extending along a direction parallel to a direction of a rotational shaft of the applying roller, the support unit being configured to support the liquid holding member such that the liquid holding member is passively rotatable around the pivotal shaft to follow the peripheral surface when the liquid holding member is biased towards the peripheral surface by the bias unit, wherein, when viewed in the direction of the rotational shaft of the applying roller, an axis of the pivotal shaft of the support unit is positioned inside a quadrangle formed by connecting:

(i) a rotating center of the applying roller, (ii) an upstream tangent point between the applying roller and an upstream side of the liquid holding member in a rotation direction of the applying roller, (iii) a downstream tangent point between the applying roller and a downstream side of the liquid holding member in the rotation direction of the applying roller, and (iv) an intersection point between a tangent line of the applying roller passing through the upstream tangent point and a tangent line of the applying roller passing through the downstream tangent point.

2. The ink jet printing apparatus according to claim 1, wherein the support unit further comprises:

a support member connected with the liquid holding member through the pivotal shaft, and movable together with the liquid holding member in response to biasing by the bias unit.

3. The ink jet printing apparatus according to claim 1, further comprising: a counter roller that is able to contact with the applying roller, wherein the applying roller and the counter roller rotate with the medium being sandwiched between the applying roller and the counter roller to apply the liquid to the medium.

* * * * *